US012070169B1

(12) United States Patent
Richardson

(10) Patent No.: US 12,070,169 B1
(45) Date of Patent: Aug. 27, 2024

(54) BACK SCRUBBING DEVICE FOR USE IN THE SHOWER

(71) Applicant: Edwin Richardson, Brooklyn, NY (US)

(72) Inventor: Edwin Richardson, Brooklyn, NY (US)

( * ) Notice: Subject to any disclaimer, the term of this patent is extended or adjusted under 35 U.S.C. 154(b) by 0 days.

(21) Appl. No.: 18/095,681

(22) Filed: Jan. 11, 2023

(51) Int. Cl.
*A47K 7/02* (2006.01)
*A46B 9/02* (2006.01)
*A46B 15/00* (2006.01)
*A46D 1/00* (2006.01)

(52) U.S. Cl.
CPC ..... *A47K 7/024* (2013.01); *A46B 9/026* (2013.01); *A46B 15/0097* (2013.01); *A46D 1/0207* (2013.01); *A46B 2200/1006* (2013.01)

(58) Field of Classification Search
CPC ..... A47K 7/00; A47K 7/024; A47K 7/026; A47K 7/03; A46B 2200/1006
See application file for complete search history.

(56) References Cited

U.S. PATENT DOCUMENTS 5,312,666 A * 5/1994 Jovanovic ..... A47K 7/024 4/606
5,628,083 A * 5/1997 Hayes ..... A47K 7/024 4/606
5,822,824 A * 10/1998 Dion ..... A47K 7/024 4/606
9,301,656 B2 4/2016 Lee
9,795,257 B1 * 10/2017 June ..... A47K 7/024
11,089,916 B2 8/2021 Reynolds
2002/0166187 A1 * 11/2002 Rowe ..... A47K 7/024 4/606
2008/0250594 A1 * 10/2008 Green ..... A47K 7/024 15/210.1
2011/0094049 A1 * 4/2011 Chen ..... A47K 7/024 15/244.1
2021/0106184 A1 * 4/2021 Jacobs ..... A47K 7/024

FOREIGN PATENT DOCUMENTS

BR 102014006959 A2 * 11/2015 ..... A47K 7/024
DE 4307338 A1 * 9/1994 ..... A47K 7/024
DE 202011104891 U1 * 4/2012 ..... A47K 7/024
DE 202014005127 U1 * 10/2014 ..... A47K 7/046
FR 3028406 A1 * 5/2016 ..... A47K 7/024
WO WO-2004039302 A1 * 5/2004 ..... A47K 7/024

OTHER PUBLICATIONS

DE 20 2011 104 891 U1; English translation; Haack; Apr. 2012.*
FR 3 028 406; English translation; Foglia; May 2016.*

* cited by examiner

*Primary Examiner* — Randall E Chin
(74) *Attorney, Agent, or Firm* — Sanchelima & Associates, P.A.; Christian Sanchelima; Jesus Sanchelima

(57) ABSTRACT

A back scrubbing device for use in the shower including a scrubber assembly and a fixing assembly. The scrubber assembly includes a scrubber having protruding elements protruding thereof. The protruding elements are brushes. The scrubber curves outward. The scrubber is used to scrub the back of a user when the user scratches against the scrubber. The fixing assembly includes fasteners. The scrubber is removable attached to a shower wall through the fasteners. The fasteners are suction cups attached to a rear portion of the scrubber.

6 Claims, 2 Drawing Sheets

BACK SCRUBBING DEVICE FOR USE IN THE SHOWER

II. BACKGROUND OF THE INVENTION

1. Field of the Invention

The present invention relates to a back scrubbing device for use in the shower and, more particularly, to a back scrubbing device for use in the shower that is fixed to a surface to allow scrubbing the back of a person.

2. Description of the Related Art

Several designs for scrubbing have been designed in the past. None of them, however, include suction cups to fix the scrubbing to a predetermined surface.

Applicant believes that a related reference corresponds to U.S. Pat. No. 11,089,916 issued for a fluid dispensing back scrubbing device which can be attached to a tub or shower surface with suction cups. Applicant believes that another related reference corresponds to U.S. Pat. No. 9,301,656 issued for a full back scrubbing apparatus with suction cup fasteners. None of these references, however, teach of a back scrubbing and cleaning device that is comprised of a rubber scrubbing mat which is attached to a shower wall with a plurality of suction cup mounting members which allows a person to scrub their own back.

Other documents describing the closest subject matter provide for a number of more or less complicated features that fail to solve the problem in an efficient and economical way. None of these patents suggest the novel features of the present invention.

III. Summary of the Invention

It is one of the objects of the present invention to provide a back scrubbing device for use in the shower that includes fasteners that allow fixing the back scrubbing device to a predetermined surface It is another object of this invention to provide a back scrubbing device for use in the shower that includes attaching means that are used to fix the back scrubbing device to fasteners.

It is still another object of the present invention to provide a back scrubbing device for use in the shower that includes a back scrubbing device having a curved shape for an easier scrubbing of the back, the device being suitable to be moisture in soap.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 1 represents an isometric operational view of the present invention 10 being used for scrubbing the back of a user.

FIG. 2 shows an isometric view of the present invention 10. The present invention includes a scrubber assembly 20, and a fixing assembly 40.

V. DETAILED DESCRIPTION OF THE EMBODIMENTS OF THE INVENTION

Figure 1:
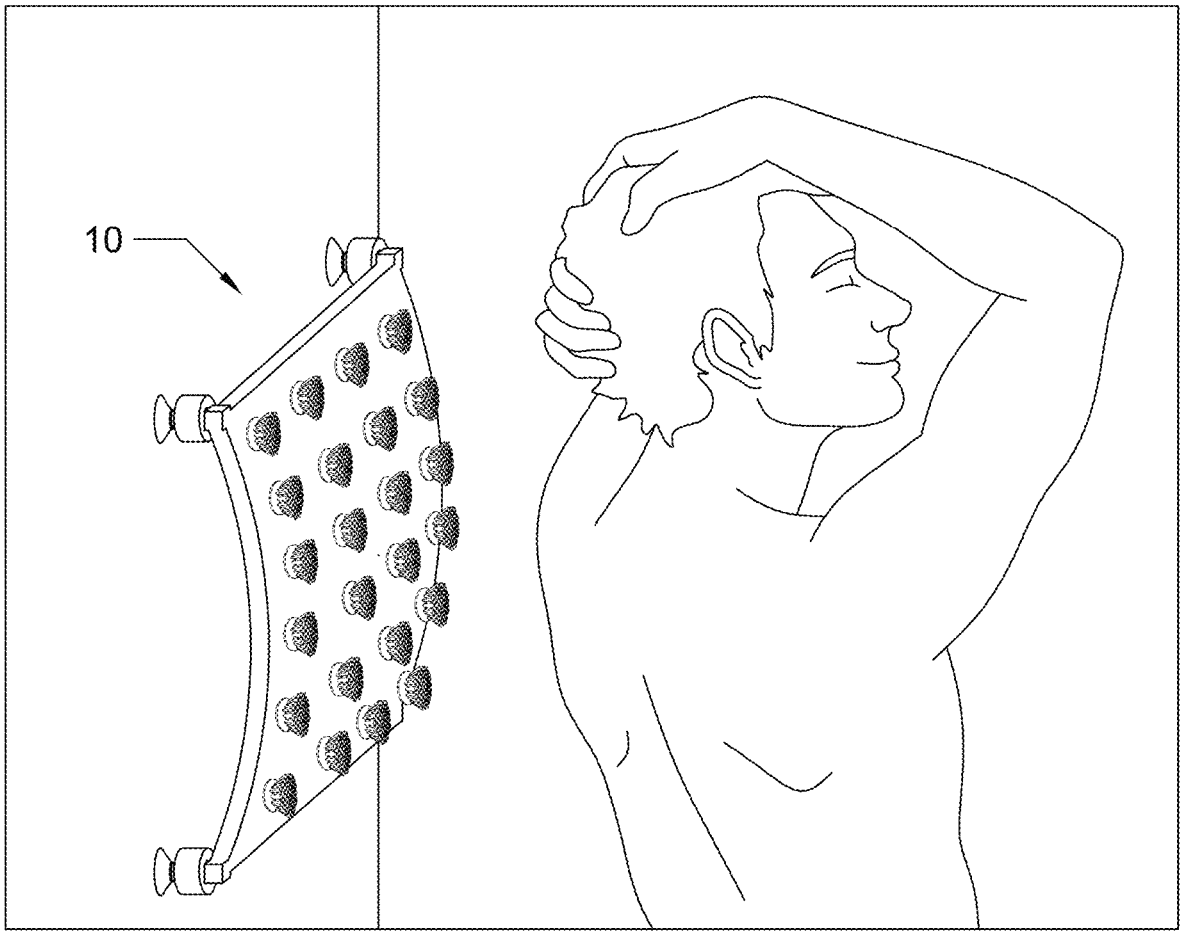
Figure 2:
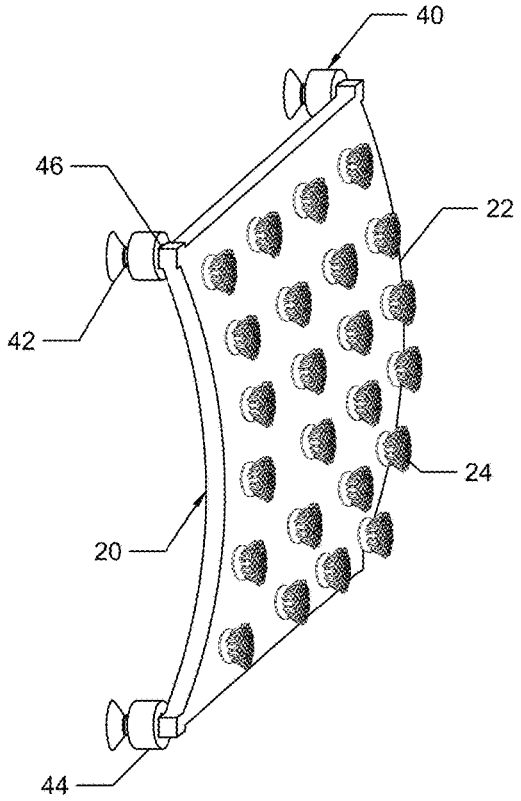
FIG. 2A shows an isometric view of the fixing assembly 40.
Figure 2A:
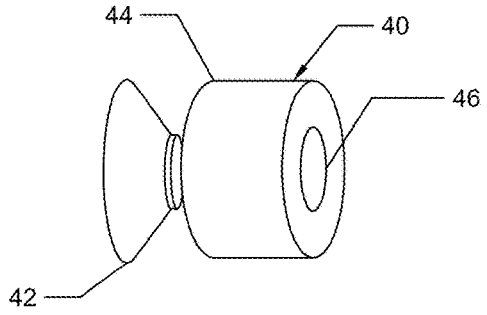

Referring now to the drawings, where the present invention is generally referred to with numeral 10, it can be observed that it basically includes a scrubber assembly 20 and a fixing assembly 40. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Figure 3:
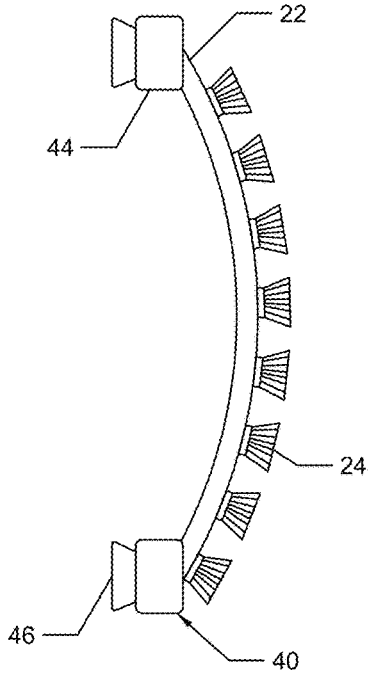
FIG. 3 illustrates a cross sectional view of the present invention 10 where curvature of the scrubber assembly 20 is shown.

The scrubber assembly 20 may include a scrubber 22 and protruding elements 24. The scrubber 22 may substantially have a rectangular curved shape. As best illustrated in FIG. 3 the scrubber 22 may curve outwardly. A central portion of the scrubber 22 may extend outwardly with respect to a top and bottom portion of the scrubber 22. It also may be suitable for the scrubber 22 to have a circular shape, a triangular shape, or any other suitable shape. In an exemplary embodiment the scrubber 22 may be made of silicone or rubber. The scrubber 22 may be flexible but hard enough to conserve a curved shape when a user scrubs his back thereagainst. It also may be suitable for the scrubber 22 to be made of fabric, polyethylene terephthalate, High-Density Polyethylene, wood, or any other suitable material. In yet another embodiment the scrubber 22 is made of silicone or rubber on the inside and a fabric on the outside. The scrubber 22 may be used to scrub the user's back or any other part of the user's body.

The scrubber 22 may have protruding elements 24. The protruding elements 24 may be equidistantly disposed in a front face of the scrubber 22. The protruding elements 24 may protrude forward from the scrubber 22. The protruding elements 24 may substantially have a circular shape. The protruding elements 24 may be bristles protruding outwardly therefrom. The protruding elements 24 may be made of horsehair, goat hair, nylon, polyvinyl chloride, polyethylene, or any other suitable material. It also may be suitable for the protruding elements 24 to have a rectangular shape, a triangular shape, or any other suitable shape. The protruding elements 24 may equidistantly disposed in the scrubber 22. It may be suitable for the protruding elements 24 to be made of rubber or silicone on the inside and made of a fabric on the outside. The corners of the scrubber 22 may be planar. The corners of the scrubber 22 may be attached to the fixing assembly 40.

Figure 4:
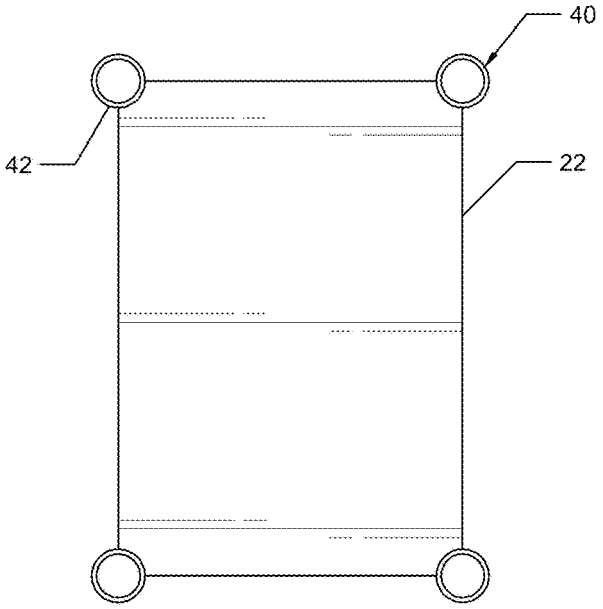
FIG. 4 is a representation of a rear view of the present invention 10.

The fixing assembly 40 may include fasteners 42, a supporting element 44 and attaching means 46. The fasteners 42 may be extra deep suction cups, bellows suction cups, oval suction cups or any other suction cups known in the prior art. It also may be suitable for the fasteners 42 to be adhesive elements, nuts and bolts, or any other fastener known in the prior art. The fasteners 42 may have a tapered shape. The fasteners 42 may be made of neoprene, polyvinyl chloride, or any other suitable material. As best shown in FIG. 4 the fasteners 42 may be located on a rear portion of the corners of the scrubber 22. It also may be suitable for the fasteners 42 to have any other configuration in the scrubber 22. The fasteners 42 may be attached to the scrubber 22 by means of the supporting element 44.

The supporting elements 44 may provide support to the scrubber 22. The supporting elements 44 may include springs or a shock absorber system. The supporting elements 44 may absorb the effort applied to the fasteners 42 when pushing the scrubber 22. The supporting elements 44 may have a cylindrical shape. It also may be suitable for the supporting elements 44 to have a rectangular shape, a triangular shape, or any other suitable shape. The fasteners 42 may be attached to a rear portion of the supporting elements. The supporting elements 44 may have attaching means 46. Attaching means 46 may be located on a front portion of the supporting elements 44.

The attaching means 46 may be a hook and fastener, an opening to introduce a bolt, an adhesive, magnets, or any other suitable attaching mean known in the prior art. It should be understood that a rear portion of the scrubber's corners may include elements suitable to be attached to the attaching means 46. The attaching means 46 may be located on a front portion of the supporting elements 44. In a preferred embodiment the user may fix the scrubber 22 to a wall through the fixing assembly 40. The user may add lotion or liquid soap to the scrubber 22. The scrubber 22 may be used to scrub the user's back. The scrubber 22 may remain attached in a predetermined position of the wall by means of the fasteners 42. The scrubber 22 may be detached from the supporting elements 44 through the attaching means 46.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A back scrubbing device for use in the shower, comprising:

a scrubber assembly, wherein said scrubber assembly includes a scrubber, wherein said scrubber curves outward, said scrubber is made of silicone rubber, said scrubber includes protruding elements, wherein said protruding elements protrude forward from a front wall of said scrubber, wherein said protruding elements are equidistantly disposed in said scrubber, said protruding elements have a circular shape; and a fixing assembly, wherein said fixing assembly includes fasteners, wherein said fasteners are attached to said scrubber, wherein said scrubber is configured to removably attach to a shower wall by means of said fasteners, wherein said scrubber is configured to scrub the back of a user wherein said fixing assembly includes attaching means, said attaching means are connected to said fasteners, wherein a portion of said scrubber is capable of being removably attached to said attaching means, said fixing assembly includes supporting elements, said supporting elements connects said attaching means with said fasteners, wherein said supporting elements include springs therinto.

2. The back scrubbing device for use in the shower set forth in claim 1, wherein said scrubber has a rectangular shape and four corners, wherein each of said four corners are planar.

3. The back scrubbing device for use in the shower set forth in claim 1, wherein said fasteners are suction cups.

4. The back scrubbing device for use in the shower set forth in claim 1, wherein said protruding elements include bristles thereby defining brushes.

5. A back scrubbing device for use in the shower, comprising:

a scrubber assembly, wherein said scrubber assembly includes a scrubber and protruding elements, wherein said scrubber has a rectangular shape, said scrubber curves outward, said scrubber has planar corners extending outwardly from said scrubber, wherein said protruding elements protrude forward from a front wall of said scrubber, said protruding elements have a hemispherical shape; and a fixing assembly, wherein said fixing assembly includes fasteners and attaching means, wherein said fasteners are suction cups, said fasteners are attached to said scrubber by means of said attaching means, wherein said scrubber is configured to removably attach to a shower wall by means of said fasteners, wherein said scrubber is configured to scrub the back of a user, said fixing assembly includes supporting elements, said supporting elements connects said attaching means with said fasteners, wherein said supporting elements include springs therinto.

6. A back scrubbing device for use in the shower, consisting of:

a scrubber assembly, wherein said scrubber assembly includes a scrubber and protruding elements, wherein said scrubber has a rectangular shape, said scrubber curves outward, wherein said scrubber is made of silicone rubber, said scrubber has planar corners extending outwardly from said scrubber, wherein said protruding elements protrude forward from a front wall of said scrubber, said protruding elements have a hemispherical shape, said protruding elements are equidistantly disposed in said scrubber; and a fixing assembly, wherein said fixing assembly includes fasteners, supporting elements and attaching means, wherein said fasteners are suction cups, said fasteners are attached to said scrubber by means of said attaching means, said attaching means are located on a front wall of said supporting elements, said supporting elements include a spring therein, said planar corners are removably attached to said attaching means, wherein said scrubber is configured to removably attach to a shower wall by means of said fasteners, wherein said scrubber is configured to scrub the back of a user.

* * * * *